United States Patent [19]

Blecha

[11] 4,366,847

[45] Jan. 4, 1983

[54] LOG SPLITTER

[76] Inventor: Wayland C. Blecha, Rte. #1 - Box 100, Cochrane, Wis. 54622

[21] Appl. No.: 215,420

[22] Filed: Dec. 11, 1980

[51] Int. Cl.[3] ..... B27L 7/00

[52] U.S. Cl. ..... 144/193 R; 60/633; 125/23 R; 144/193 G

[58] Field of Search ..... 125/23; 144/193 R, 193 A, 144/193 G; 60/632, 633, 636, 638

[56] References Cited

U.S. PATENT DOCUMENTS 885,458 4/1908 Eckenroth, Jr. ..... 144/193 A 4,218,888 8/1980 Jayne ..... 60/632

*Primary Examiner*—W. D. Bray

*Attorney, Agent, or Firm*—A. W. Breiner

[57] ABSTRACT

A log splitter which utilizes as the prime mover a one-cylinder internal combustion engine. The engine is a two-cycle engine, with the fuel-air mixture being manually supplied to the engine by way of a charging unit. The internal combustion engine is of a size to provide the desired impact striking of the log to be split, followed by the application of sufficient force to continue the splitting.

14 Claims, 7 Drawing Figures

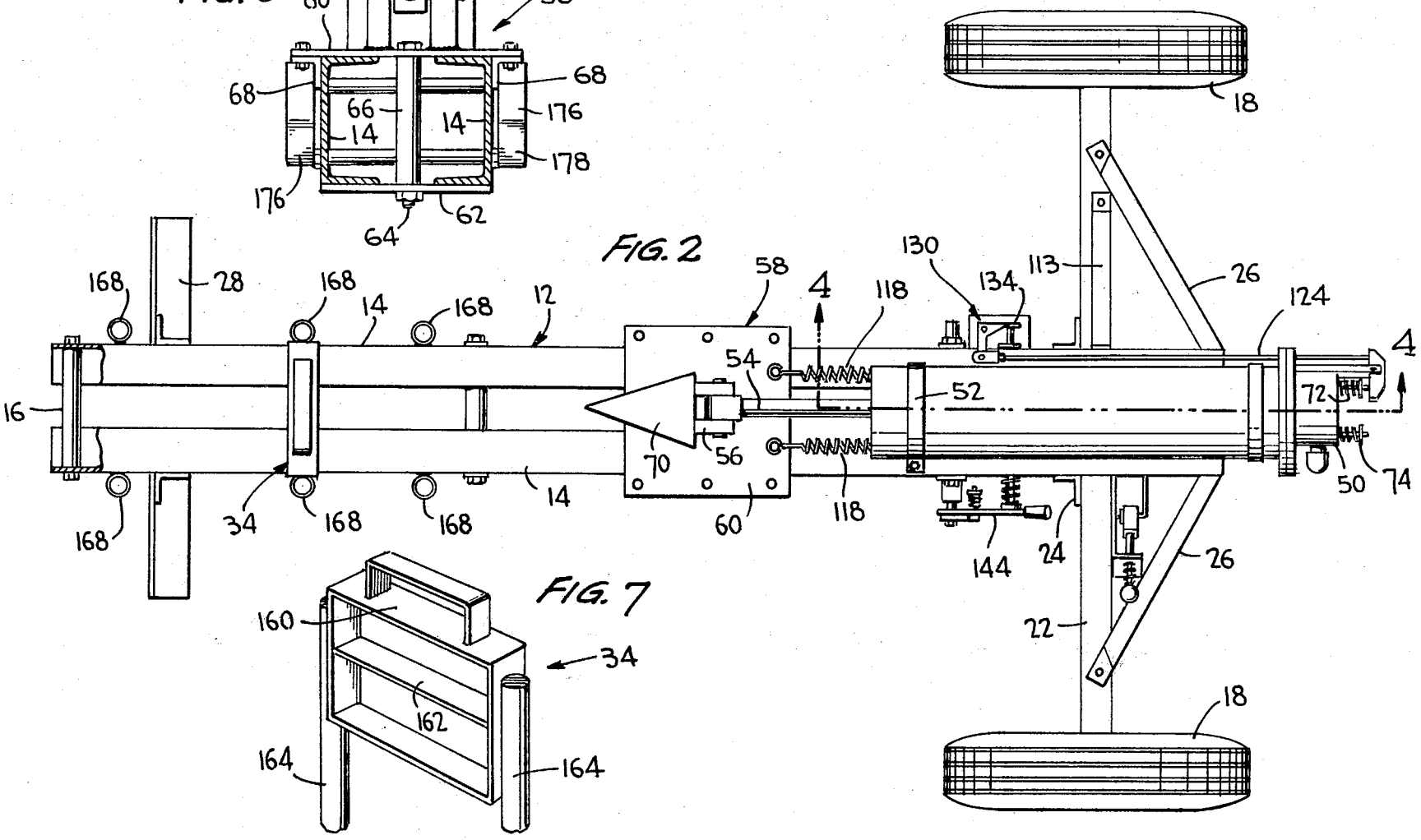
FIG. 2
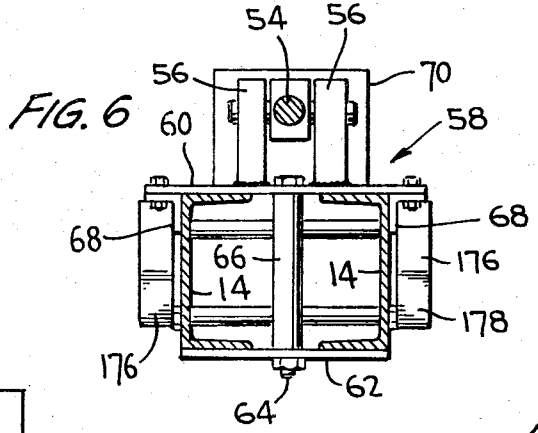
FIG. 6
FIG. 7

LOG SPLITTER

This invention relates in general to new and useful improvements in equipment for harvesting firewood and, more particularly, to a novel log splitter.

Log splitters are well known. The most common log splitter is one employing a hydraulic cylinder together with the necessary attachment including a reservoir, a pump, and a motor for driving the same. Not only are such splitters expensive due to the equipment required, but also relatively slow in that a large cylinder is required to provide the necessary splitting force, thus necessitating a large volume of oil to be pumped into the cylinder during each actuation thereof.

Log splitters employing hydraulic cylinders do not have the advantage of an impact striking the log and, thus, must rely solely upon the exertion of a force on the splitting head.

While there has been devised a splitter which utilizes a reciprocating ram driven by means of flywheels to utilize the impact advantage, these splitters have other disadvantages including the necessary mounting of large flywheels and the driving of the same.

In accordance with my invention, I provide a wood splitter which relies upon the combination of impact and force to split logs and the like. Simply, I provide a two-stroke cycle, one cylinder, internal combustion engine wherein the piston of the engine is directly coupled to a log-engaging member. The cylinder, when fired, rapidly drives the piston so that the log-engaging member strikes the log with the impact, and at the same time the cylinder may be of sufficient diameter to provide the necessary splitting force.

The internal combustion engine may operate effectively on gasoline, although it may employ other fuels including liquid gases such as propane. The engine has a one-cycle operation, with each cycle of operation being controlled by the splitter operator.

The splitter is of a very simple construction with a very simple fuel supply and ignition system whereby there is nothing to go wrong and, thus, it is suitable for operation in all localities.

Having described the invention in general terms, specific and presently preferred embodiments will be set forth in the context of the illustrative drawing.

FIG. 2 is a top plan view of the log splitter of FIG. 1 and shows further the details thereof;

FIG. 6 is an enlarged fragmentary transverse vertical sectional view taken generally along line 6—6 of FIG. 1 and shows the details of the frame and the mounting of a carriage thereon; and FIG. 7 is an enlarged prospective view, with parts broken away, of a log stop.

Figures 1, 4:
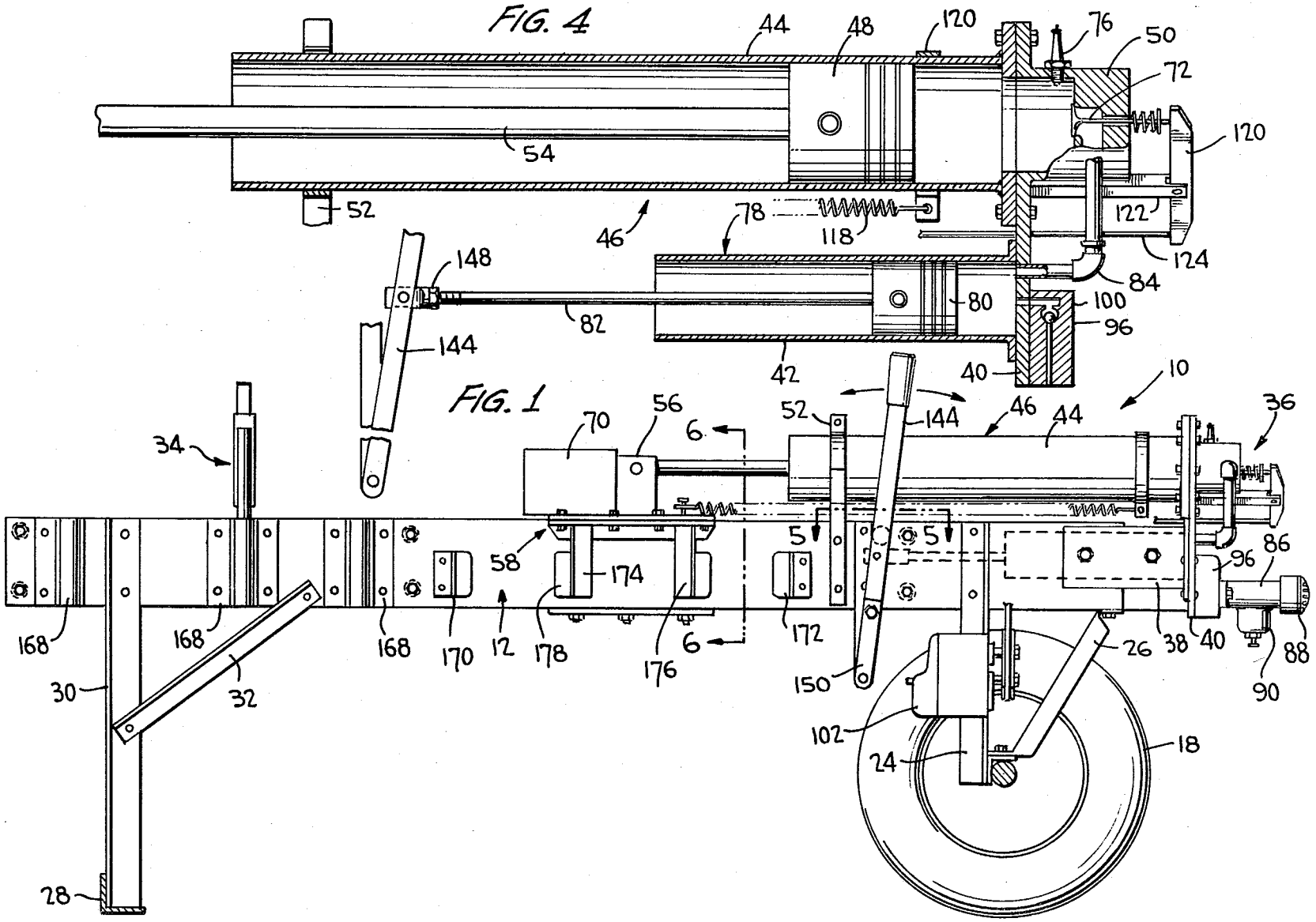
FIG. 1 is a side elevational view of a log splitter with one wheel and a part of a ground support thereof broken away.
FIG. 4 is an enlarged fragmentary vertical sectional view taken generally along line 4—4 of FIG. 2, and shows specifically the details of the engine cylinder and the charging cylinder.

Referring now to the drawing in detail, it will be seen that there is illustrated the log splitter which is the subject of this invention, the log splitter being generally identified by the numeral 10. The log splitter 10 includes an elongated frame, generally identified by the numeral 12. The frame 12, as is best shown in FIGS. 2 and 6, is formed of two elongated channel members 14 which are mounted with their webs vertically disposed and the channel members arranged in spaced-apart, opposite opening relation. The frame members 14 are suitably secured together, particularly at the ends thereof, by means of spacers such as the bolt and pipe spacer 16 shown at the left end of FIG. 2.

Figure 3:
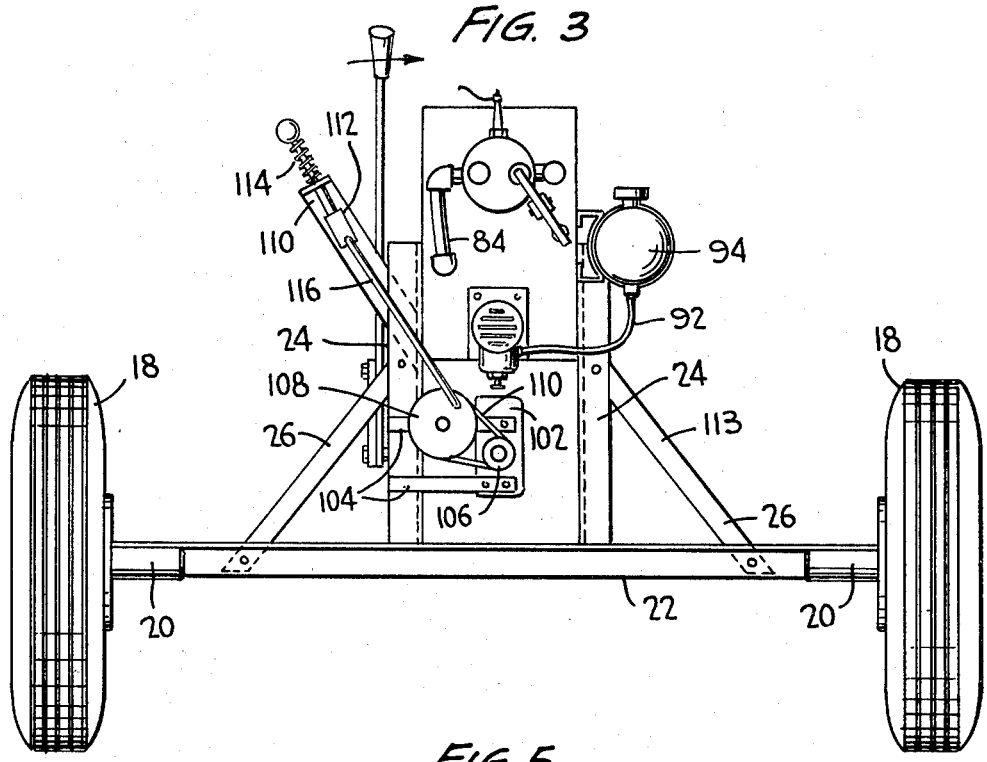
FIG. 3 is a front elevational view of the log splitter.

As is best shown in FIGS. 1 and 3, the front end of the frame 12 is supported by a pair of wheels 18 which are carried by spindles 20. The spindles, in turn, are carried by a transverse angle member 22 which is secured to a pair of depending frame members 24 secured to opposite sides of the frame 12. The angle member 22 is further braced by diagonal braces 26 which extend downwardly and rearwardly from the bottom of the frame 12.

The rear of the frame 12 is supported by a suitable support which includes a base member 28 carried at the lower end of frame members 30 depending from opposite sides of the frame 12. Diagonal braces 32 also connect the frame 12 to the frame members 30.

If desired, the base member 28 may be omitted and the frame members 30 shortened so that the rear of the frame may be supported by suitable wheels (not shown). Further, a suitable trailer tongue may be secured to the frame members 30 and braced with suitable diagonal braces for attaching the log splitter to the rear of a suitable towing vehicle.

The log splitter includes a log stop, generally identified by the numeral 34, and a splitting head, generally identified by the numeral 36. The log stop 34 will be described in more detail hereinafter.

The frame 12 is provided at the forward end thereof with extensions 38 which support a vertical mounting plate 40. The mounting plate 40, as is best shown in FIG. 4, carries a lower charging cylinder 42, which is disposed generally within the frame 12, and an upper engine cylinder 44. The engine cylinder 44, which is part of a two-stroke cycle reciprocating internal combustion engine 46, has mounted therein for reciprocation a piston 48. The left end of the cylinder 44 is opened, while the right end is closed by a head 50 which is suitably secured to or may be formed as part of the mounting plate 40. At this time it is pointed out that the rear portion of the cylinder 44 is also supported by a removable mounting bracket 52.

The piston 48 has pivotally coupled thereto in the conventional manner an elongated piston rod 54 which extends out of the left end of the cylinder 44 and is pivotally coupled to an upstanding bracket 56 on a carriage generally identified by the numeral 58.

The carriage 58, as is best shown in FIG. 6, is slidably mounted on the frame 12 for movement therealong and includes an upper plate 60 which rests on the channel members 14. The plate 60 is coupled to a lower plate 62 which underlies the channel members 14 and is secured thereto by means of suitable bolts 64 extending to tubular spaces 66.

The carriage 58 also includes a pair of side guides 68 which underlie the outer edges of and are secured to the plate 60.

Referring now to FIG. 2, it will be seen that the carriage 58 carries a log-engaging member 70 which is preferably in the form of a tapered splitting element. The log-engaging member 70 is carried by the mounting bracket 56 which is preferably in the form of a pair of upstanding plates. It is to be understood that the log-engaging member 70 could be in the form of a pusher head which then would require a splitter to be carried by the log stop 34.

Referring now to FIGS. 2 and 4, it will be seen that the head 50 carries an exhaust valve 72 and an intake valve 74, both of which are of the spring-loaded, normally closed type. The spring-loading of the intake or inlet valve 74 is relatively light, and it will be automatically opened by the introduction of a pressurized fuel-air mixture. On the other hand, the exhaust valve 72 must be manually actuated in a manner to be described hereinafter.

The head 50 for the engine cylinder 44 also is provided with a spark plug 76 which is part of a magneto-type ignition system.

In order that an explosive fuel-air mixture may be delivered to the engine cylinder 44, there is a charging unit generally identified by the numeral 78. The charging unit 78 includes a charging cylinder 42 which has mounted therein for reciprocating movement a charging piston 80. The charging cylinder 42 has the right end thereof closed by the plate 40 which also functions as a head for the cylinder 42. The left end of the charging cylinder 42 is opened and has extending therethrough and therebeyond an elongated piston rod 82 which is pivotally connected to the piston 80 in the usual manner.

The charging cylinder 42 has the head portion thereof opening into an inlet conduit 84 which extends into the head 50 and terminates in a chamber normally closed by the intake valve 74. However, as stated above, when a pressurized fuel-air mixture is directed against the intake valve 74, it will automatically open because of a slight spring pressure.

The charging unit 78 also includes a carburetor 86 suitable for a small internal combustion engine, the carburetor including an air-intake portion 88 and a fuel supply bowl 90. As is best shown in FIG. 3, the fuel supply bowl 90 receives fuel through a fuel line 92 from a fuel tank 94 which is mounted on one side of the frame 12. It is to be understood, however, that the carburetor 86 will vary depending upon the fuel.

The carburetor 86 is carried by an inlet manifold block 96 which is mounted on the plate 40 and, as is shown in phantom lines at FIG. 4, includes a supply passage 98 which is closed by a one-way ball check valve member 100.

The ignition system for the engine 46 is of a magneto type and includes a conventional magneto 102 which is carried by a pair of support arms 104. The magneto includes a drive pulley 106 which is driven from a driven pulley 108 by a drive belt 110. The driving pulley 108 is mounted on one of the supports 104.

A suitable support 110 extends upwardly to one side of the frame from one of the frame members 24, as is best shown in FIG. 3. A manually actuated push rod member 112 is carried by the upper end of the support member 110 and is resiliently urged to an uppermost position by a spring 114. A link 116 extends between the push member 112 and the driving pulley 108 to impart a rotary movement to the driving member 108 upon the depressing of the push rod assembly 112. While the driving pulley 108 is rotated only a part of a revolution, the relative sizes of the pulleys 106 and 108 are such that a complete revolution of the pulley 106 and, thus, the magneto 102 is assured. It is also to be understood that when the magneto is for an eight-cylinder engine, there will be eight spark impulses on the forward stroke of the push rod and eight sparks on the return stroke, thereby assuring ignition of the fuel charge in the cylinder.

Relatively simple controls are provided for actuating the charging unit 78 and the engine 46. First of all, the piston 48 is always returned to a position closely adjacent the head 50 by means of a pair of return springs 118 which extend between the bracket 120 on the cylinder 44 and the carriage 58, as is best shown in FIGS. 2 and 4.

As explained above, the intake valve 74 is self-actuating. The exhaust valve is manually actuated by means of a lever 120 mounted on a bracket 122 projecting from the head 50. The lever 120 is pivoted in a counter-clockwise direction to open the exhaust valve 72 by means of a push rod 124 which extends longitudinally of the frame 12.

Figure 5:
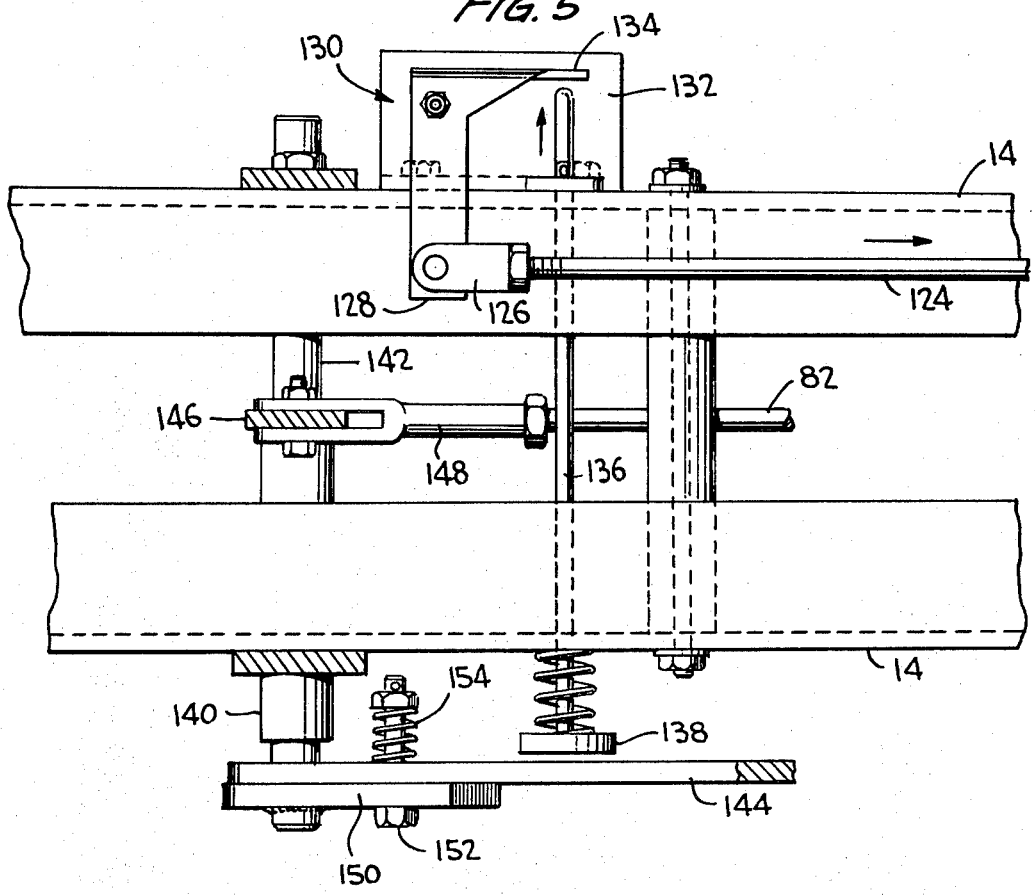
FIG. 5 is an enlarged fragmentary top plan view of the device with the engine cylinder omitted and shows the details of control linkage.

Referring now to FIG. 5 in particular, it will be seen that the opposite end of the push rod 124 is provided with a fitting 126 which pivotally connects the push rod 124 to one leg 128 of a bell crank 130. The bell crank 130 is pivotally mounted on a bracket 132 carried by one of the channel members 14.

The bell crank 130 has a second leg 134 which extends generally parallel to the frame members 14 and is in the way of the transversely extending push rod 136 which extends through the frame members 14. The push rod 136 is provided at its opposite end with an enlarged head 138 and is spring retracted.

The channel members 14 are provided with a mounting sleeve or bushing 140 for a transversely extending pivot shaft 142. The pivot shaft 142 carries adjacent one end thereof a charging lever 144 and is provided intermediate its ends with a crank arm 146. The crank 146 has pivotally connected thereto a fitting 148 which is carried by the free end of the piston rod 82.

At this time it is pointed out that the charging lever 144 is slidably mounted on the pivot shaft 142, but is secured thereto for pivoting therewith. To this end the free end of the pivot shaft 142 is provided with a lever 150 which is fixed thereto and which is connected to the charging lever 144 by an elongated bolt 152. The bolt 152 carries a compression spring 154 which normally holds the charging lever 144 against the lever 150, but permits it to be moved transversely inwardly towards the adjacent channel member 14. It is to be noted that the head 138 of the transverse push rod 136 is disposed closely adjacent to the charging lever 144, and it is in position to be engaged by the charging lever 144 when the charging lever 144 is in its retracted position. Thus, by first moving the charging lever 144 transversely, the exhaust valve 72 may be opened to vent the engine cylinder 44.

It is to be understood that when the charging lever 144 is in its retracted position, the charging cylinder 42 is filled with a fuel-air mixture. When the charging lever 144 is moved forwardly, it moves the piston 80 forwardly so as to force the fuel-air mixture out of the cylinder 42 under pressure into the engine cylinder 44. The engine cylinder 44 is thus charged with the fuel-air mixture ready to be ignited by the spark plugs 76 through the actuation of the magneto 102.

When the charging piston 80 is retracted by utilizing the charging lever 144, it will drawn in a new fuel-air supply through the carburetor 86 unless the charging unit 78 is ready to again charge the engine when ready.

At this time it is pointed out that the charging lever 144 is not illustrated as having associated therewith a return spring. It is normally moved to its retracted position manually in that the force of a return spring must be overcome when the charging piston 80 is moved thereby to effect a charging of the engine.

It is also pointed out here that it is feasible to provide a suitable linkage whereby the charging piston 80 may be foot-actuated to provide for a greater charging force.

Referring now to FIG. 7, it will be seen that there are illustrated details of the log stop 34. The log stop 34 is preferably in the form of a generally rectangular frame 160 having at least one crossbar 162. In this manner logs of different diameters will be automatically engaged by the log stop.

The frame 160 has depending from opposite sides thereof support rods 166 which are selectively receivable in mounting sleeves 168 which are secured to the channel members 14 at opposite sides of the frame 12 in longitudinally spaced relation. This permits the log stop 34 to be positioned at different points along the length of the frame 12 for the splitting of logs of different lengths. The frame may also have a suitable upper handle.

It will be readily apparent that it is not desirable to permit the log-engaging member 70 to engage the log stop 34 under any circumstances. In a like manner, it is desirable to prevent the piston 48 from striking the head or the mounting plate 40 at the forward end of its stroke. Accordingly, there is carried by the channel members 14 on opposite sides of the frame 12 a pair of longitudinally spaced stops 170 and 172. In a like manner, there is carried by each of the angle members 68 on opposite sides of the carriage 58 depending bumpers 174 and 176. It is to be understood that the stops 170, 172 and the bumpers 174, 176 are preferably provided with resilient pads 178.

The bumpers 170 and 174 cooperate to limit the log splitting stroke of the engine 46 while the bumpers 176 and 172 cooperate to limit the return stroke of the piston 48 under the influence of the springs 118.

At this time it is pointed out a suitable shielding may be required around the moving parts of the log splitter. However, that shielding has been omitted for purposes of clarity.

The operation of the log splitter is very simple. After the engine 46 has been charged, the handle 116 for the magneto push rod assembly 112 is pushed down and the engine 46 fires to effect the movement of the carriage 58 and the log-engaging member 72 along the frame 12 to effect the splitting of a log seated on the frame 12 to the right of the log stop 34. The piston 48 is returned to its starting position by the springs 118, with the exhaust gases being generally compressed within the head of the engine 46. Then the lever 144 is first moved transversely to open the exhaust valve, after which it is moved forwardly to effect the operation of the charging piston 80. After the charging piston 80 has moved forwardly and then rearwardly, the log splitter is ready to split a further log.

Although only a preferred embodiment of the log splitter has been specifically described, it is to be understood that moderate variations in the log splitter may be made without departing from the spirit or scope of the invention as defined by the appended claims.

It is claimed:

1. A log splitter comprising a frame, a log stop carried by said frame and a splitting head mounted on said frame in opposition to said log stop, an internal combustion engine mounted on said frame and extending longitudinally thereof, said internal combustion engine being of a type including cylinder means, piston means, a piston rod, and means for igniting a source of fuel, said piston rod carrying on of said splitting head or said log stop for movement longitudinally of said frame, said cylinder means being of sufficient diameter whereby when ignition of the fuel occurs, said piston is driven with impacting force sufficient to perform the intended log splitting operation.

2. A log splitter according to claim 1 together with a separate charging unit coupled to said engine cylinder means for supplying said cylinder means with a fuel-air mixture.

3. A log splitter according to claim 2 wherein said engine is of the two-stroke cycle and said charging unit includes means for compressing said fuel-air mixture.

4. A log splitter according to claim 2 wherein said charging unit includes a charging cylinder and a reciprocating charging piston, charging means for introducing a fuel-air mixture into said charging cylinder in response to retraction of said charging piston.

5. A log splitter according to claim 4 together with conduit means joining said engine cylinder means to said charging cylinder, and a normally closed inlet valve controlling said conduit means, said inlet valve being openable in response to a pressurized fuel-air mixture in said conduit.

6. A log splitter according to claim 4 wherein said charging means includes a carburetor and a supply conduit coupling said carburetor to said charging cylinder, and a one-way valve in said supply conduit.

7. A log splitter according to claim 4 together with a manual actuator for reciprocating said charging piston.

8. A log splitter according to claim 7 wherein said engine cylinder means has normally closed exhaust valve, and linkage means positioned for actuation by a manual actuator coupled to said exhaust valve for effecting opening of said exhaust valve.

9. A log splitter according to claim 1 together with a manually actuated ignition system for said engine.

10. A log splitter according to claim 1 together with a manually actuated ignition system for said engine including a magneto and a manual drive for rotating said magneto.

11. A log splitter according to claim 1 wherein said splitting head includes a carriage mounted on said frame and coupled to said piston means rod, and said log-engaging member being carried by said carriage.

12. A log splitter according to claim 11 together with stop means for limiting the moving of said piston means within said engine cylinder means, said stop means including cooperating stop elements on said frame and said carriage.

13. A log splitter according to claim 12 together with plural mounting means for said log stop carried by said frame for modifying said log splitter to receive logs of different lengths.

14. A log splitter according to claim 4 wherein said charging cylinder is mounted within said frame and said engine cylinder means is disposed above said frame and generally parallel to said frame and said charging cylinder.

* * * * *